US005667094A

United States Patent [19]

Rapchak et al.

[11] Patent Number: 5,667,094

[45] Date of Patent: Sep. 16, 1997

[54] CONTAINER AND CLOSURE ASSEMBLY

[75] Inventors: Thomas P. Rapchak; Michael Marino, both of New Castle, Pa.

[73] Assignee: West Penn Plastics, New Castle, Pa.

[21] Appl. No.: 638,804

[22] Filed: Apr. 29, 1996

[51] Int. Cl.[6] ..... B65D 43/16; B65D 55/16

[52] U.S. Cl. ..... 220/339; 220/780; 220/375; 215/306

[58] Field of Search ..... 220/339, 306, 220/780, 793, 794, 796, 805, 375; 215/235, 237, 224, 45, 43, 306, 305

[56] References Cited

U.S. PATENT DOCUMENTS

| | | | |
|---|---|---|---|
| 2,814,404 | 11/1957 | Towns | 215/306 X |
| 3,282,477 | 11/1966 | Henchert | 220/375 X |
| 3,470,930 | 10/1969 | Jurczenia | 220/780 |
| 3,592,349 | 7/1971 | Baugh | 215/45 X |
| 3,786,982 | 1/1974 | Rakes et al. | 220/339 X |
| 3,900,550 | 8/1975 | Oliver et al. | 220/339 |
| 4,377,247 | 3/1983 | Hazard et al. | 215/235 X |
| 4,655,363 | 4/1987 | Neat . | |
| 4,783,056 | 11/1988 | Abrams . | |
| 4,812,116 | 3/1989 | Abrams . | |
| 4,813,570 | 3/1989 | Pontoppidan | 215/224 X |
| 4,860,907 | 8/1989 | Sondal | 215/235 X |
| 5,012,941 | 5/1991 | Abrams et al. . | |
| 5,133,470 | 7/1992 | Abrams et al. . | |
| 5,269,430 | 12/1993 | Schlaupitz et al. | 220/339 X |
| 5,441,150 | 8/1995 | Ma | 220/306 X |
| 5,513,768 | 5/1996 | Smith | 215/306 X |
| 5,575,399 | 11/1996 | Intini | 220/339 X |

FOREIGN PATENT DOCUMENTS

| | | | |
|---|---|---|---|
| 6617154 | 6/1978 | Netherlands | 215/235 |

*Primary Examiner*—Allan N. Shoap
*Assistant Examiner*—Nathan Newhouse
*Attorney, Agent, or Firm*—Harpman & Harpman

[57] ABSTRACT

A container and cap assembly of the type comprising an integral molded container and hinge cap. The container having a neck surrounding an opening thereto with a rim extending thereabout. The cap is interconnected to the container by a living hinge, aligning the cap with the neck for sealing registration thereon. Engagement and release tabs extend from the respective container and cap portions for angularly aligned positioning to one another upon cap registration on the container.

7 Claims, 2 Drawing Sheets

CONTAINER AND CLOSURE ASSEMBLY

BACKGROUND OF THE INVENTION

1. Technical Field

This invention relates to containers and cap assemblies such as molded plastic vials where the integral hinge closure has flange means for connecting with a rim on the container to form a leak-proof barrier therebetween.

2. Description of Prior Art

Prior art devices of this type have been directed to molded vial and cap assemblies which are produced in sterile environments in which the cap is seated on the container in a closed position before it is ejected from the manufactured mold, see U.S. Pat. Nos. 4,783,056 and 4,812,116.

Other prior art directed to container and cap assemblies can be seen in tamper evident devices, see U.S. Pat. No. 5,012,941 as well as U.S. Pat. Nos. 5,133,470, 4,655,363.

SUMMARY OF THE INVENTION

A container and cap assembly for sealing registration with one another in a antiseptic sterile environment wherein the cap is integrally molded on a hinge element extending from the container. The cap having a closure skirt and depending sealing flange for continuous engagement on registering rim of the container.

DESCRIPTION OF THE PREFERRED EMBODIMENT

Figure 1:
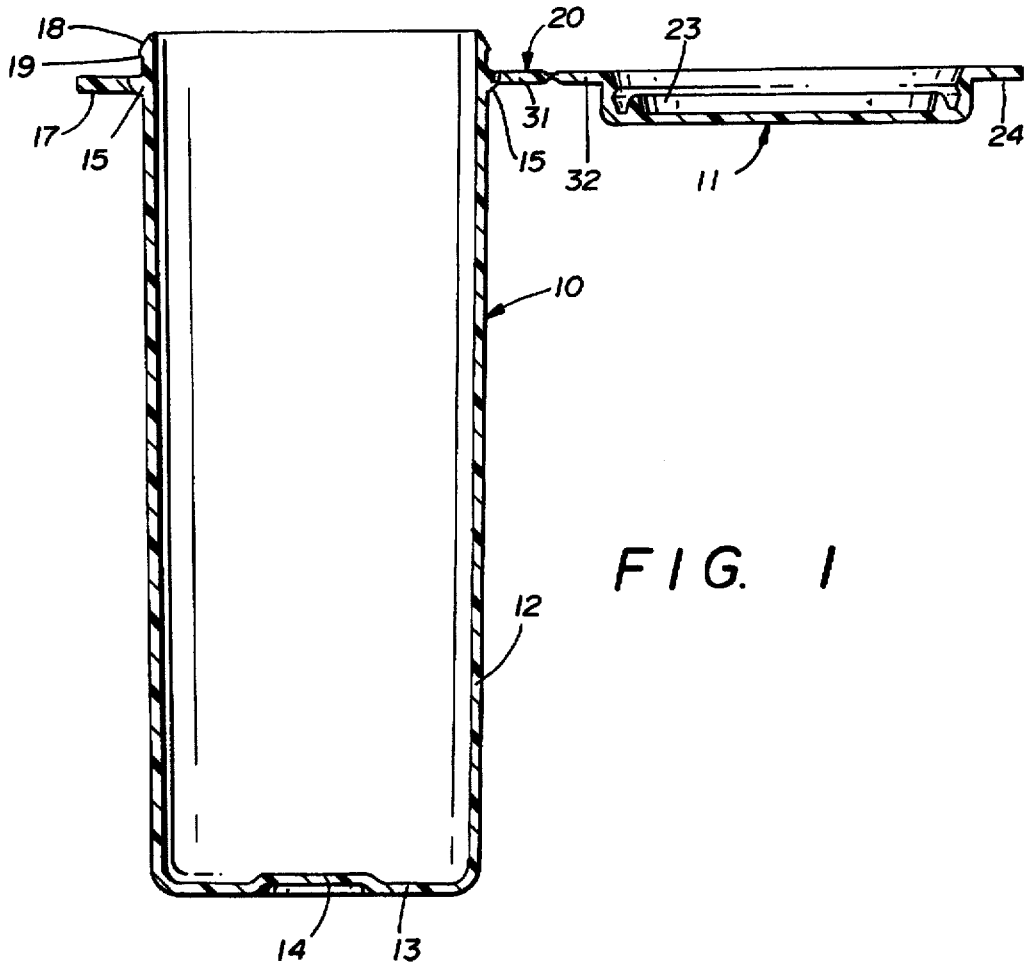
FIG. 1 is a longitudinal sectional view through the plastic container and cap assembly on lines 1—1 on FIG. 3.

Referring to the drawings, the reference number 10 designates a container and the reference number 11 designates a closure in accordance with the present invention. The container 10 and closure 11 are preferably of a one-piece molded thermoplastic body construction. The container 10 has an annular sidewall 12 with an integral bottom portion 13 with a centered recess area at 14 therein. The container includes an integral flange 15 extending circumferentially from the outer surface of the annular sidewall 12. An integral tab 17 extends from a portion of the flange 15. The container 10 has an annular rim portion defined by angular engagement surfaces 18 and 19.

Figure 2:
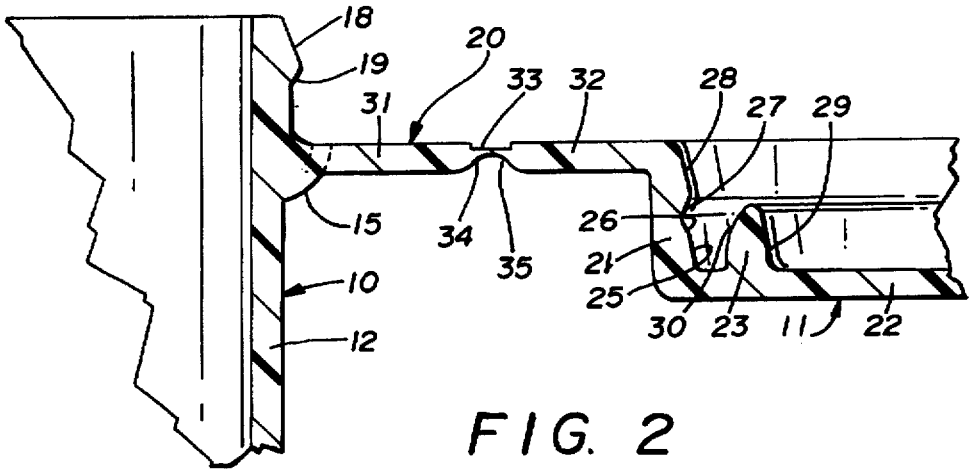
FIG. 2 is an enlarged cross-sectional view of the rim and cap portion of the invention.
Figure 4:
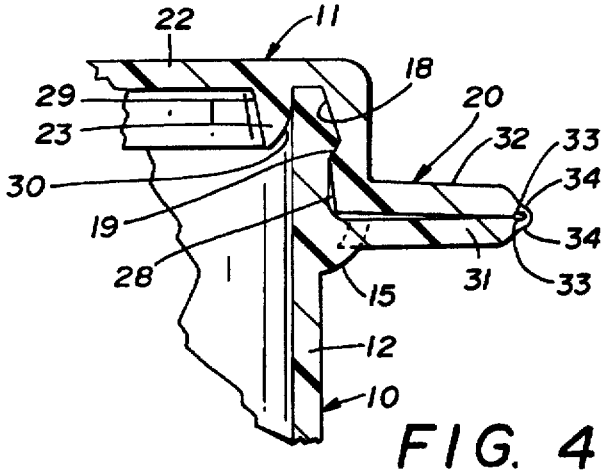
FIG. 4 is an enlarged cross-sectional view of a portion of the enlarged cap and container rim in closed position.

The closure 11 is joined to the container 10 by an integral hinge 20 about which the closure may swing between open and close position illustrated respectively in FIG. 2 and 4 of the drawings.

Figure 3:
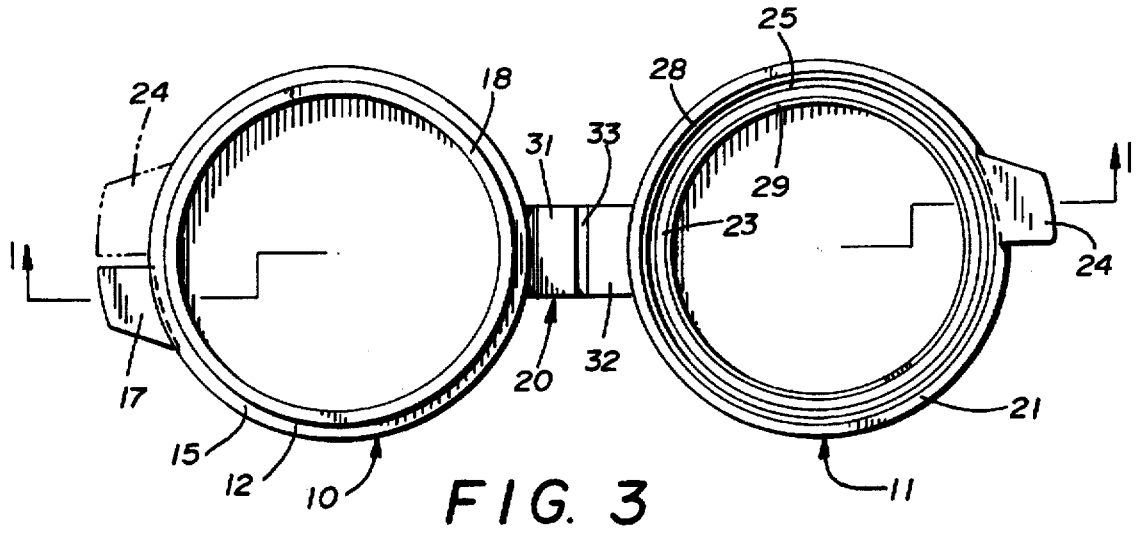
FIG. 3 is an enlarged top plan view of the invention.

The closure 11 has a depending annular skirt 21, a top 22 and an annular sealing flange 23 extending from said top 22 in spaced relation from said skirt 21. A tab 24 extends from the skirt 21 opposite said hinge 20 and is offset in relation to the container tab 17 along its vertical axis as best seen in FIG. 3 of the drawings. The skirt 21 has an inner contoured surface characterized by a first angular plane surface 25 of approximately 10 degrees from the reference vertical, a second angular plane surface 26 of approximately 18 degrees from a reference vertical extending therefrom. A third angular surface 27 extending inwardly therefrom with a fourth angular plane surface 28 that is generally parallel with said first plane surface 25.

The annular sealing flange 23 has an angular inside surface 29 with a curved outer upper surface portion 30 extending to a vertically disposed surface in spaced relation to said skirt 21 as hereinbefore described.

Referring to FIG. 2 of the drawings, it will be seen that the hinge 20 has a container portion 31 and a closure portion 32 with an area of reduced dimension therebetween.

The tapered engagement surfaces 18 and 19 of the rim portion on the container 10 are registerable within the closure 11 between the closure skirt 21 and sealing flange 23. The engagement surface 18 has an 18 degree vertical inclination from reference vertical, matching that of the second angular plane surface 26 during registering engagement with the closure 11. The engagement surface 19 has a 30 degree vertical inclination opposite said surface 18 for locking engagement against the corresponding intermediate surface 27 of the closure 10 frictionally securing same as best seen in FIG. 4 of the drawings under the container 10.

Figure 5:
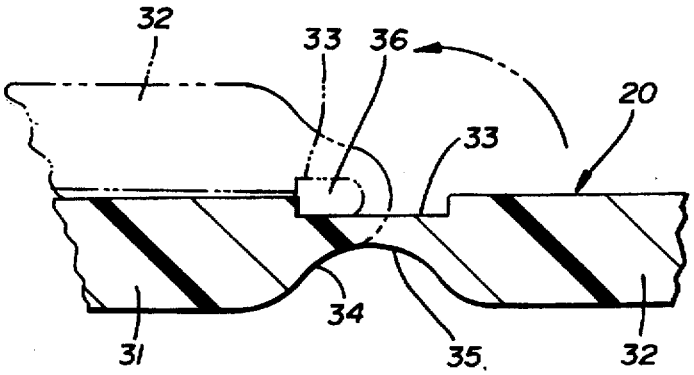
FIG. 5 is an enlarged cross-sectional view of the hinge portion of the invention.

Referring now to FIGS. 3, 4 and 5 of the drawings, the hinge 20 has a transverse recess 33 within and an oppositely disposed contoured notch 34 that extend beyond the recess area 33.

In use, the aforementioned recess 33 and notch 34 of the hinge 20 imparts the flexibility and clearance needed between the hinge's container portion 31 and closure portion 32 when the closure 11 swings into a closed position and the closure 11 is press fit to the rim of the container 10 as best seen in FIG. 4 of the drawings.

Referring now to FIGS. 1 and 3 of the drawings, the position of the tabs 17 and 24 are shown on the container 10 and closure 11 respectively in the open position in solid lines, and in closed position in broken lines which illustrates the tab 17 and 24 being adjacent the position for opening engagement by the user (not shown) as will be understood by those skilled in the art.

Referring to FIG. 5 of the drawings, the transverse recess 33 and opposing contoured notch 34 defines a flexible area therebetween at 35 which when flexed upon itself during closure illustrated by the broken lines in FIG. 5 of the closure portion 32 on the container portion 31 forms a "flex space" at 36 therebetween.

It will thus be seen that a new and novel container and cap assembly has been illustrated and described and that while the best mode for carrying out the invention has been described in detail, those familiar with the art to which the invention relates will recognize various alternative designs and embodiments for practicing the invention as defined by the following claims.

We claim:

1. A container and cap assembly comprising;

a container and a closure that are integrally molded from plastic to one another, said container having an annular sidewall with a closed end and an open end surrounded by a locking rim with two tapered engagement surfaces, engagement tabs extending from said container and said closure respectively, said closure having a depending skirt and a sealing flange engageable on said rim by downwardly closure movement to secure said closure in a closed position on said container and prevent upward movement of said closure, said skirt having four angular plane engagement surfaces, wherein the first and second angular plane engagement surfaces having different vertical inclinations and engage one of said tapered engagement surfaces on said container adjacent said opening, the third angular plane engagement surface extends below said first and second angular plane engagement surfaces and engages on said remaining rim's tapered surface, and the fourth angular plane engagement surface extends from said third angular plane engagement surface in spaced relation to said annular sidewalls when closed, said hinge having a recessed portion and a contoured notch in spaced oppositely disposed relation to one another defining a flexible means therebetween.

2. The container and cap assembly of claim 1 wherein said first angular plane engagement surface is of a vertical angular inclination of 10 degrees and said second angular plane engagement surface is of a vertical angular inclination of 18 degrees.

3. The container and cap assembly as set forth in claim 1 wherein said rim's tapered engagement surface registerable on said first and second annular plane engagement surfaces of said closure is of a vertical inclination of 18 degrees.

4. The container and cap assembly of claim 1 wherein said recess portion in said hinge extends transversely thereacross and is of a known depth and width and said oppositely disposed contoured notch is of a depth and width greater than that of said known recess.

5. The container and cap assembly of claim 1 wherein said flexible means between said container and said closure when in closed position defines a space therebetween.

6. The container and cap assembly of claim 1 wherein said third angular plane engagement surface is of a vertical angular inclination of 30 degrees.

7. The container and cap assembly of claim 1 wherein said first and fourth angular plane engagement surfaces are of an identical vertical angular inclination.

* * * * *